United States Patent [19]

Chao

[11] Patent Number: 4,638,649

[45] Date of Patent: Jan. 27, 1987

[54] DUAL ACTION LUGGAGE LATCH

[75] Inventor: Ting-Tsung Chao, Taipei, Taiwan

[73] Assignee: Echolac Co., Ltd., Taipei, Taiwan

[21] Appl. No.: 731,283

[22] Filed: May 7, 1985

[51] Int. Cl.[4] ..... E05B 65/52; E05C 3/04

[52] U.S. Cl. ..... 70/71; 292/207; 292/DIG. 31; 70/208

[58] Field of Search ..... 292/106, 113, 143, 207, 292/DIG. 31; 70/69, 71, 70, 72, 73, 74, 75, 76, 208

[56] References Cited

U.S. PATENT DOCUMENTS

| | | | |
|---|---|---|---|
| 2,717,796 | 9/1955 | Cudney | 292/DIG. 31 |
| 2,894,777 | 7/1959 | Hogan | 292/113 |
| 2,921,810 | 1/1960 | Smith | 292/113 |
| 3,250,558 | 5/1966 | McCpintock | 290/207 |
| 4,134,281 | 1/1979 | Pepcin | 292/DIG. 31 |

*Primary Examiner*—Robert L. Wolfe

*Attorney, Agent, or Firm*—Burns, Doane, Swecker & Mathis

[57] ABSTRACT

A latch means adapted to lock the luggage, attache cases or the like, comprising two actuating members abuttingly mounted on a same plane, the abutting edges thereof being connected separately to two parallel pivot pins. The two actuating members are movable in opposite directions under the external force, the outer edge of one of the two members is depressible under the external force applied thereto while that of the other of the actuating members can be lifted up. A sliding member is movable in between the two actuating members under the action of the second actuating member, and with the change of position of the sliding member, only when the first actuating member is depressed, can the second actuating member be lifted up thereby permitting the latch bolt to be released from the corresponding hole and the latch means is then in an unlocking position. However, when the second actuating member in a raised position, that is, in the unlocked condition, is simply depressed, the latch means will then be in a locked position and at the same time the first actuating member without having the external force applied thereto will be automatically sprung back to its original position.

9 Claims, 10 Drawing Figures

DUAL ACTION LUGGAGE LATCH

BACKGROUND AND OBJECTS OF THE INVENTION

The present invention relates generally to a luggage latch, and, more particularly to a dual action latch means that can be adapted to lock the luggage, attache cases or the like.

Conventionally, a luggage latch requires in most cases two operational actions, one for unlocking and the other for locking of the latch. In other words, in its construction the latch needs only to operate a single lock bolt element to achieve unlocking or locking purposes. Though in operation the conventional luggage latch may be of a convenient type, it however presents much insecurity in the stability of its locking condition, since the only lock bolt element often causes the latch to be unlocked unexpectedly due to its being unintentionally touched and such things happen quite often with the travelling luggages during transfer or transportation from one place to another. As a result of this, the unlocking element with a second locking device has long been the object persons skilled in the art seek to work out. An ideal latch means should nevertheless possess the following characteristic:

1. The operational element to control the unlocking of the latch bolt must itself be controlled by another locking device.
2. Before the latch bolt is unlocked, the first locking device must first be set free so that the second locking device may be moved about.
3. During the unlocking process, the operation of the first and the second locking devices must be in continuity.
4. The unlocking movements of the first and the second locking devices must not be in same direction.
5. In locking the latch, a single action should suffice to achieve the effect.

In view of the afore-said disadvantages in the conventional luggage latch, it is necessary for the present invention to design an ideal latch device which would satisfy all of the above-enumerated characteristics. Accordingly, it is an object of the present invention to provide a luggage latch device having double locking means with unlocking of which requiring two operational actions while locking of which needs a single action only.

It is a further object to provide a luggage latch device which can be unlocked only upon application of two continual movements in different directions.

It is yet another object of the invention to provide a luggage latch device of the type, which in addition to being of high stability is also easy to operate and further, of which unlocking by an inadvertent touching can also be prevented.

THE DRAWINGS

Other objects and advantages of the present invention will become apparent from the following detailed description of a preferred embodiment thereof in connection with the accompanying drawings, in which.

DETAILED DESCRIPTION OF A PREFERRED EMBODIMENT OF THE INVENTION

Figure 1:
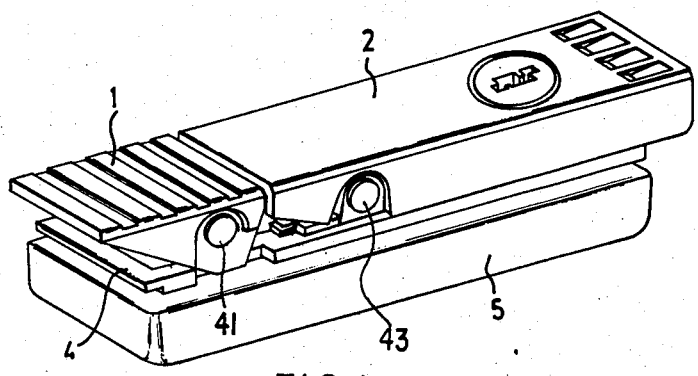
FIG. 1 is a perspective view of a latch means in accordance to the present invention.

Referring now to FIG. 1, the latch means of the present invention comprises a first actuating member 1, a second actuating member 2, a sliding member 3, a seat body 4 and a bottom cover 5. The body and cover are attached together and form a base. The first actuating member 1 includes outer and inner edges 1A, 1B, respectively (FIG. 3), and the second actuating member includes outer and inner edges 2A, 2B, respectively.

Figure 4:
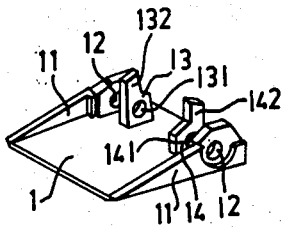
FIG. 4 is a perspective view of a first actuating member of the latch means of the present invention showing the bottom side thereof upwardly.

As illustrated in FIG. 4, the first actuating member 1 of the present invention is provided on the opposite sides of the bottom surface thereof with two triangular side plates 11, the two side plates 11 each at one end thereof having in corresponding position an opening 12 while the regions inner to the side plates and spaced apart being formed with two projecting teeth 13, 14. The displacement teeth 13, 14 are again provided with holes 131, 141 respectively, which holes are aligned in the same shaft line with the openings 12 while the tooth tips 132, 142 of the teeth 13, 14 respectively are mutually offset, that is, tips 132, 142, are not in alignment.

Figure 5:
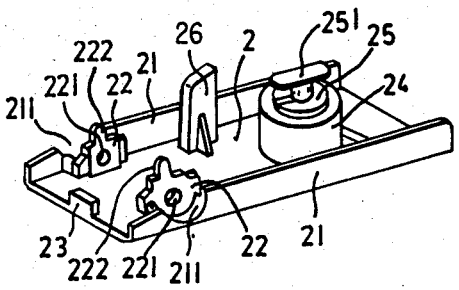
FIG. 5 is a perspective view of a second actuating member of the latch means of the present invention showing the bottom side thereof upwardly.

As shown in FIG. 5, the second actuating member 2 of the present invention is provided on the lateral sides of the bottom surface thereof with side plates 21, the two side plates 21 having at each one end close to the terminal portion in corresponding position a circular notch 211. Inner to the notch 211, projecting teeth 22 of similar shape are formed one at each side in corresponding position, the teeth 22 being provided each with a shaft hole 221 and each terminating in a tooth tip 222. On the bottom surface at the middle of one edge of the actuating member 2 there is projected a stop means 23 and in the middle section on the bottom surface the actuating member 2 includes a plate like lock pin 26, while towards the rear portion thereof the actuating member 2 further includes a cylinder seat 24 to receive a lock cylinder 25 thereinto. The lock cylinder 25 has at the bottom thereof a rotatable latch bolt 251.

Figure 6:
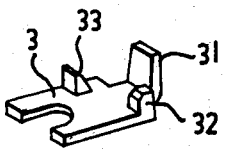
FIG. 6 is a perspective view of a sliding member of the latch means of the present invention.

The sliding member 3, as illustrated in FIG. 6, has one end extended into a narrowed upstanding stop arm 31, and in addition, the sliding member 3 includes two projecting angles 32, 33 on the top surface at each side shoulder portion thereof. The angles 32, 33 are not positioned in the same level, the angle 32 projecting out at the terminal end of the sliding member 3 while the angle 33 is some distance behind the terminal end.

Figure 2:
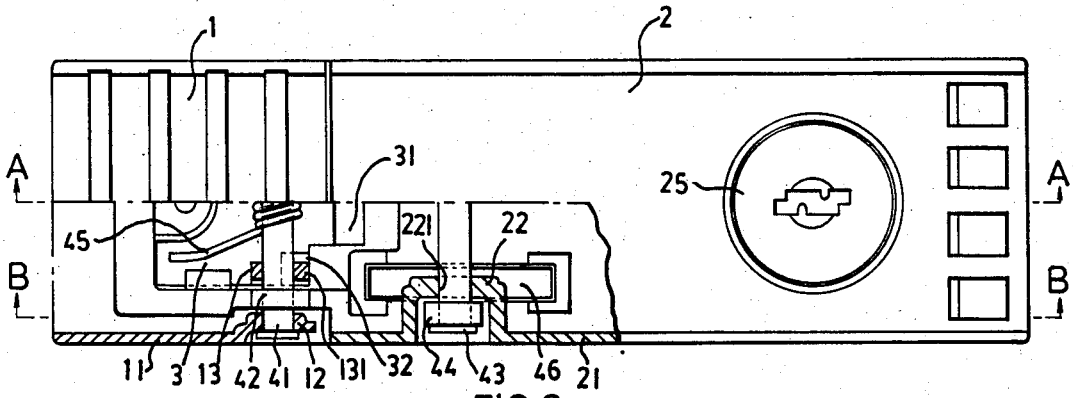
FIG. 2 is a top elevational, partially sectional view of the latch means of FIG. 1.
Figure 3:
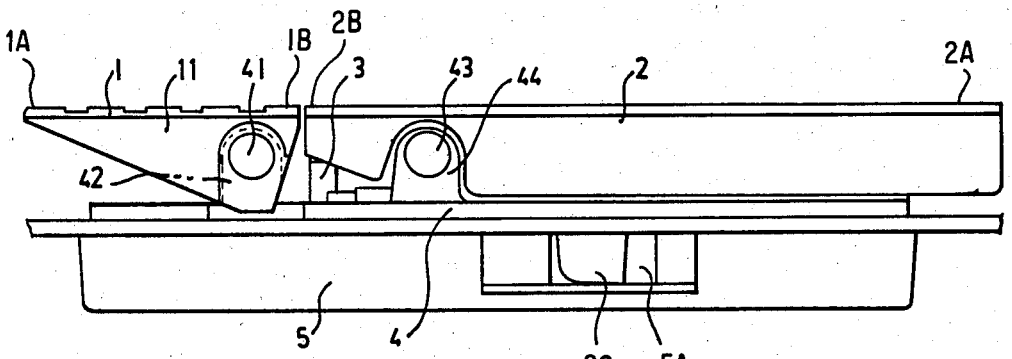
FIG. 3 is a side elevational view of the latch means of FIG. 1.
Figure 7:
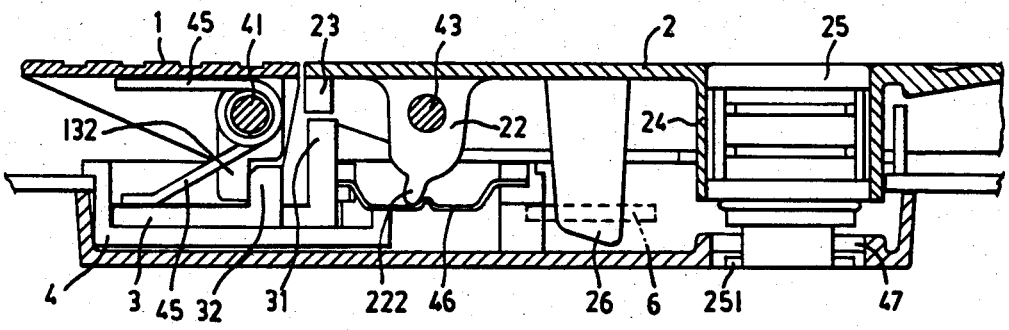
FIG. 7 is a sectional view taken along the line A—A of FIG. 2 showing the latch means in the locked condition.

As can be seen by reference to FIGS. 2, 3 and 7, a pivot pin 41 passes through in proper order the openings 12 in the two side plates 14 of the first actuating member 1, a pair of lugs 42 on the seat body 4 and the holes 131, 141 in the projecting teeth 13, 14 on the inside of the first actuating member 1, thereby pivotally connecting the first actuating member 1 to the to the front of the seat body 4, and the sliding member 3 is thus secured beneath or behind the pivot pin 41 within the seat body 4. Another pivot pin 43 passes through in proper order another pair of lugs 44 and the holes 221 in the projecting teeth 22 at each side on the bottom of the second actuating member 2, thereby pivotally connecting the second actuating member 2 to the seat body 4. Since a torsional spring 45 is mounted on the pivot pin 41, the first actuating member 1 when is not under any external force will be urged by the spring action thereby keeping the top surface thereof in a horizontal position. Similarly, corresponding to positions of the two projecting teeth 22 on the bottom surface of the second actuating member 2 there are mounted two spring leaves 46 underneath each projecting tooth 22 which leaves are engaged by the tooth tips 222. The two spring leaves 46 provide an elastic force in a clockwise direction to the second actuating member, whereby when the latter is not under any external force, the top or front surface thereof may rest in a horizontal plane. Since the first actuating member 1 and the second actuating member 2 are abutting against each other, for esthetic purposes, the top surfaces thereof can be designed accordingly to be on the same plane.

Figure 10:
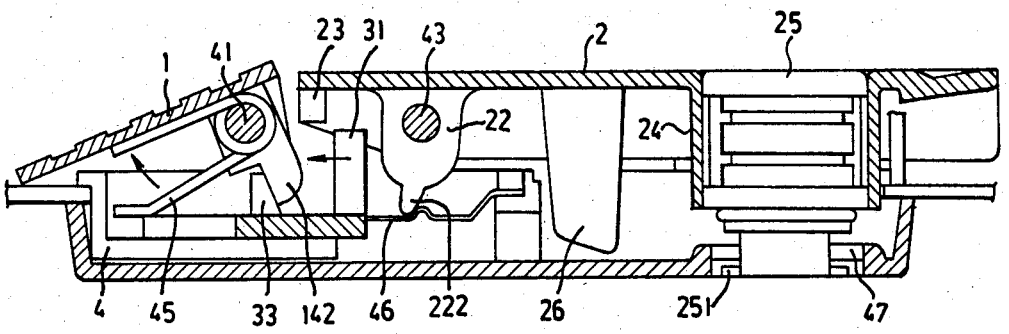
FIG. 10 is a schematic view similar to FIG. 9 depicting the latch means in action of engaging.

The first actuating member 1 is pivotally connected, as shown in FIGS. 7, 10, to the seat body 4 and the tooth tip 132 of the projecting tooth 13 on one side of the bottom surface thereof is positioned outside of (i.e., to the left of) the projecting angle 32 on the top surface of the sliding member 3, while the tooth tip 142 of the projecting tooth 14 on the other side is placed inside of (i.e., to the right of) the projecting tooth 33 on the top surface of the sliding member 3. Under such condition when there is no external force being applied to the first actuating member 1, the elasticity of the spring 45 will not only urge the first actuating member 1 to move upwards, but also cause the tooth tip 142 to push the projecting angle 33 outwardly. Thus, the sliding member 3 will move translationally until reaching the terminus of the seat body 4 whereupon the first actuating member 1 will come to rest on a horizontal plane and will not be turning upwards any more.

As in FIG. 7, there is illustrated the latch of the present invention in a locked condition where the locking function is performed by the lock pin 26 which is fittingly inserted in a slotted hasp plate 6 which enters the cover 5 through a recess 5A (FIG. 3), to prevent the hasp plate 6 from returning back to the side, and further, since the lock pin 26 is formed integrally with the second actuating member 2, the lock pin 26 will be released from the slotted plate 6 only when the outer edge 2A of the actuating member 2 is lifted upwards under the external foce, that is, when the outer edge 2A of the second actuating member 2 is moved upwards about the pivot pin 43 in a counterclockwise direction. However, under the normal condition, when the first actuating member 1 is not under any external force, the sliding member 3 lying thereunder will remain in an outside position wherein the upstanding arm 31 on the inside end of the sliding member 3 is exactly positioned underneath the stop 23 on the inner end bottom surface of the second actuating member 2 to prevent the latter from pivoting.

Figure 8:
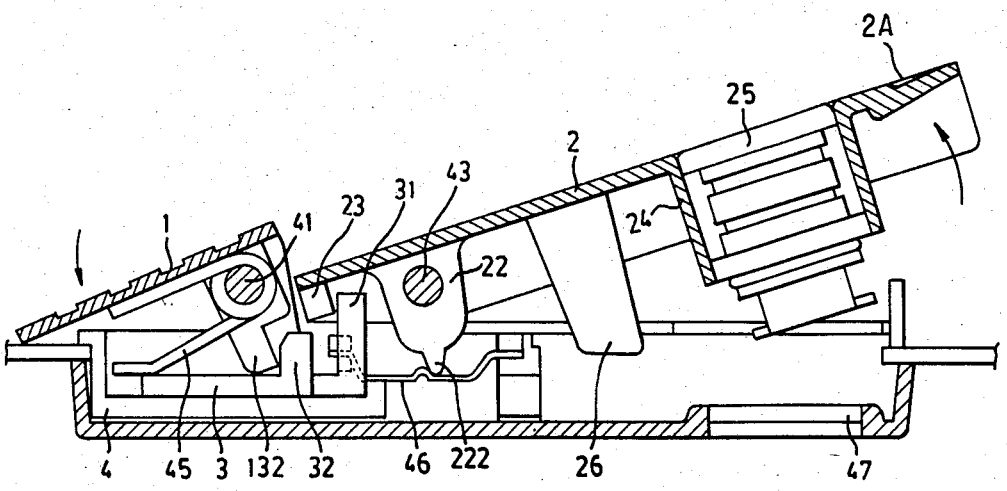
FIG. 8 is a schematic view similar to FIG. 7 depicting the latch means in action of disengaging.

As shown in FIG. 8, when it is desirable that the lock pin 26 be released from the slotted plate 6, the outer edge 1A of the first actuating member 1 must first be depressed by the operator's thumb to enable the first actuating member 1 to rotate about the pivot pin 41 in a counterclockwise direction. At this moment, the tooth tip 132 of the projecting tooth 13 on the bottom surface of the actuating member 1 will push the corresponding projecting angle 32 of the sliding member 3 inwardly (i.e., to the right of FIG. 8), thus enabling the sliding member 3 to move translationally inwardly. The upstanding arm 31 will thus be diverted from the underside of the stop 23 on the inside end bottom surface of the second actuating member 2, leaving a gap thereunder. Therefore, when the first actuating member is being depressed with a thumb, any of the other figners may then lift up the outside edge 2A of the second actuating member 2 in a counterclockwise direction, such that the second actuating member 2 will rotate about the pivot pin 43. During this rotation, when the tooth tip 222 of the projecting tooth 22 on the underside of the actuating member 2 is turned. The spring leaves 46 are provided each with a projecting fold 46A against which the tips 222 press, whereby, the spring leaves 46 will bend downwards under the force exerted by the tooth tips 222 passing over the projecting folds. After the tooth tips 222 have passed over the folds, the elastic recovery force of each spring leaf 46 will cause that fold to obstruct return travel of the tooth tip 222, thus enabling the second actuating member 2 to be maintained in an upturned inclining position. At this moment, the lock pin 26 on the underside of the second actuating member 2 will have disengaged from the slotted plate 6 and as such, the luggage latch of the present invention will now be in an unlocked condition.

Figure 9:
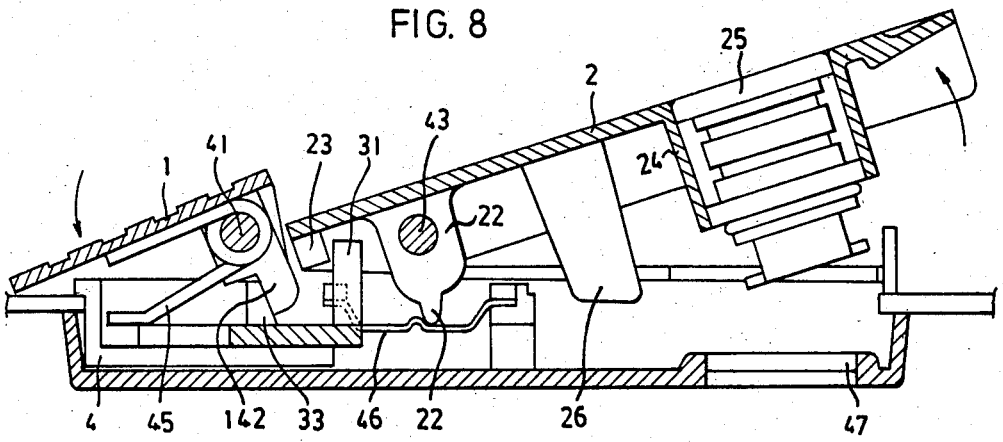
FIG. 9 is a schematic view similar to FIG. 8 but is taken along the line B—B of FIG. 2.

In FIG. 9, there is illustrated the luggage latch of the present invention in an unlocked state, where in the tooth tip 142 of the projecting tooth 14 on the outer side of the underside of the first actuating member 1 is disposed inwardly with respect to to the corresponding projecting angle 33 on the upper face of the sliding member 3. At this moment, the spring 45 possesses the elastic recovery force to cause the first actuating member 1 to rotate in a clockwise direction, However due to the upturned position of the second actuating member 2, the stop 23 on the inner terminal end of the underside thereof is disposed on the outside of the upstanding arm 31 at the inner terminal end of the sliding member 3. Thus the first actuating member 1 can not return in a clockwise direction to its original position, but is maintained in an inclined positin. This position will not vary even if the first actuating member 1 is urged by the spring 45 to push the sliding member 3 outwardly into a horizontal plane. Since the upstanding arm 31 is now being obstructed by the stop 23, the sliding member 3 can not move translationally towards the outside, nor can the first actuating member 1 return to its original position in a clockwise direction.

To place the luggage latch in a locked condition, it is required only to press the outer edge 2A of the second actuating member 2 downwards, as shown in FIG. 10, thereby permitting the second actuating member 2 to rotate about the pivot pin 43 in a clockwise direction until it returns to a horizontal plane when the luggage latch will again be in a locking condition. The upstanding arm 31 at the inside end of the sliding member 3 is now free from obstruction of the stop 23 so that the first actuating member 1 urged by the restoring resiliency of the spring 45 will rotate about the pivot pin 41 in a clockwise direction, and the tooth tip 142 will concurrently drive the sliding member 3 outwardly. When the outer edge of the sliding member 3 is stuck at the terminal portion of the seat body 4, the first actuating member 1 stops pulling upward, and comes to rest in a horizontal manner.

It will be appreciated from the foregoing that in order to unlock the luggage latch of the present invention, it is necessary to first press down the first actuating member and then continue to lift up the second actuating member. However, in locking the device it is requried only to press down the sedond actuating member and the first actuating member will automatically return to its original place. In other words, the luggage latch of the present invention requires dual continual action in unlocking thereof, while a single action is needed in locking the latch. Furthermore, in unlocking of the latch if the first actuating member is not pressed down first, it will not be possible to lift up the second actuating member. Still further, in so doing one actuating member is being pressed downwards while the other member is being lifted upwards; these two actions are of different directions, however, these two actions can be suitably performed with single hand, and casual release of the latch due to touch on a single direction can also be prevented.

As shown also in FIG. 7, the second actuating member of the latch of the present invention is further provided with a lock in which the latch bolt 251 at the bottom of the lock cylinder is protruded out beneath the seat body 4. The latch bolt 251 has a longer longitudinal length while the hole 47 which allows the latch bolt 251 to pass therethrough is a long one, the transverse aperture thereof being shorter than the longitudinal length of the latch bolt 251. Hence, when the longitudinal length of the latch bolt 251 is in alignment with the longitudinal direction of the long hole 47, the second actuating member can be lifted up as the first actuating member is being pressed down. However, if the key is inserted into the lock cylinder and turned round a ninety degree, the longitudinal direction of the latch bolt 251 will be in a crossed position with that of the long opening 47 and latch bolt 251 will thus be obstructed at the outside of the long opening 47. At this moment, even if the first actuating member is being pressed down, the second actuating member can not be lifted up.

What is claimed is:

1. A latch for use in latching a hasp of a luggage case, said latch comprising a base having a first portion; a first actuating member rotatably mounted on said front portion of said base by a first pivot pin, said first actuating member including a front surface and outer and inner edges, said outer edge being movable in response to an external force applied to said outer edge to rotate said first actuating member in a first direction from a first position to a second position about said first pivot pin; a second actuating member rotatably mounted on said front portion of said base by a second pivot pin which is parallel to said first pivot pin, said second actuating member including a front surface, an inner edge disposed adjacent said inner edge of said first actuating member, and an outer edge which is movable in response to an external force applied to said outer edge, to rotate said second actuating member in a second direction opposite said first direction from a first position to a second position, said second actuating member being engageable with the hasp in said first position of said second actuating member and disengaged from the hasp in said second position of said second actuating member; and a sliding member mounted behind said first and second actuating members and slidable relative thereto between first and second positions associated with said first and second positions, respectively, of said first actuating member; said first actuating member including first displacement means for sliding said sliding member from its first position to its second position in response to rotation of said first actuating member from its first position to its second position; said sliding member including a stop which, in said first position of said sliding member, is positioned behind a portion of said second actuating member to prevent the latter from being rotated from its first position to tis second position, said stop being moved from behind said portion of said second actuating member when said sliding member is in its second position, to permit said second actuating member to be rotated to its second position.

2. A latch according to claim 1, wherein said outer edge of said first actuating member is moved toward said base to rotate said first actuating member in said first direction, and said outer edge of said second actuating member is moved away from said base to rotate said second actuating member in said second direction.

3. A latch according to claim 1, wherein said first actuating member includes second displacement means for engaging and sliding said sliding member from its second position to its first position in response to rotation of said first actuating member from its second position to its first position.

4. A latch according to claim 3, including spring means for biasing said first actuating member to its first position.

5. A latch according to claim 3, wherein said second actuating member includes means preventing sliding of said sliding member from its second position to its first position while said second actuating member is in its second position.

6. A latch according to claim 5, including a positioning spring for yieldably retaining said second actuating member in both its first position and second position.

7. A latch according to claim 4, including releasable locking means for preventing rotation of said second actuating member out of its first position.

8. A latch according to claim 7, wherein said locking means is operable to fasten said second actuating member to said base.

9. A latch according to claim 1, wherein said second actuating member carries a lock pin which is securable to the hasp when said second actuating member is in its first position.

* * * * *